US010618279B2

(12) United States Patent
Sakai et al.

(10) Patent No.: US 10,618,279 B2
(45) Date of Patent: Apr. 14, 2020

(54) LIQUID DISCHARGING APPARATUS

(71) Applicant: SEIKO EPSON CORPORATION, Tokyo (JP)

(72) Inventors: Hirofumi Sakai, Shiojiri (JP); Takahiro Katakura, Okaya (JP); Keigo Sugai, Chino (JP); Shinichi Nakamura, Okaya (JP); Junichi Sano, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/991,243

(22) Filed: May 29, 2018

(65) Prior Publication Data

US 2018/0345663 A1 Dec. 6, 2018

(30) Foreign Application Priority Data

May 31, 2017 (JP) ..... 2017-107669

(51) Int. Cl.

| | |
|---|---|
| ***B41J 2/045*** | (2006.01) |
| ***B41J 29/38*** | (2006.01) |
| ***B41J 2/18*** | (2006.01) |
| ***B41J 2/175*** | (2006.01) |
| ***B41J 2/14*** | (2006.01) |

(52) U.S. Cl.

CPC ..... *B41J 2/04581* (2013.01); *B41J 2/04541* (2013.01); *B41J 2/14274* (2013.01); *B41J 2/175* (2013.01); *B41J 2/18* (2013.01); *B41J 29/38* (2013.01); *B41J 2202/05* (2013.01)

(58) Field of Classification Search

CPC .... B41J 2/17513; B41J 2/175; B41J 2/17596; B41J 2/04541; B41J 2/14233; B41J 2/17503; B41J 29/38; B41J 2/04581

See application file for complete search history.

(56) References Cited

U.S. PATENT DOCUMENTS

2008/0018715 A1* 1/2008 Wee ..... B41J 2/055 347/70

2010/0245425 A1 9/2010 Suzuki (Continued)

FOREIGN PATENT DOCUMENTS

JP 2010-221567 A 10/2010

JP 2010-274446 A 12/2010

*Primary Examiner* — Jannelle M Lebron

(74) *Attorney, Agent, or Firm* — Workman Nydegger

(57) ABSTRACT

A liquid discharging apparatus includes: a liquid compartment; a flowing-in passage that is in communication with the liquid compartment through a flowing-in opening, the liquid flowing through the flowing-in passage into the liquid compartment; a nozzle that is in communication with the liquid compartment through a communication opening; a capacity changer that causes the liquid contained in the liquid compartment to be discharged from the nozzle by causing a displacement of an inner wall surface of the liquid component and changing capacity of the liquid compartment; and a flowing-in passage resistance changer that changes capacity of the flowing-in passage to change flow resistance of the flowing-in passage. In the liquid compartment, as viewed from the flowing-in opening, the communication opening is located in front of a center-of-displacement portion, an amount of the displacement of which is largest in the inner wall surface displaced by the capacity changer.

9 Claims, 8 Drawing Sheets

(56) References Cited

U.S. PATENT DOCUMENTS

| | | | | |
|---|---|---|---|---|
| 2011/0169897 | A1 | 7/2011 | Yokoyama et al. | |
| 2011/0228012 | A1 | 9/2011 | Yoshida et al. | |
| 2011/0234706 | A1* | 9/2011 | Yoshida | B41J 2/14274 347/68 |
| 2017/0120602 | A1* | 5/2017 | Nakai | B41J 2/175 |

* cited by examiner

LIQUID DISCHARGING APPARATUS

BACKGROUND

1. Technical Field

The present invention relates to a liquid discharging apparatus.

2. Related Art

Various kinds of the following liquid discharging apparatus have been proposed in related art, for example, as disclosed in JP-A-2010-274446; the apparatus is configured to discharge a liquid contained in a liquid compartment from a nozzle that is in communication with the liquid compartment by changing the capacity of the liquid compartment using an actuator and by changing the pressure inside the liquid compartment.

In the liquid discharging apparatus mentioned above, preferably, the pressure inside the liquid compartment should be changed appropriately at ideal target timing for the purpose of controlling the discharging of the liquid from the nozzle with higher precision. There is a possibility of wrong droplet discharging timing or wrong discharge amount deviated from the target value if the timing of changing the pressure inside the liquid compartment deviates from the target. Moreover, there is a possibility of generation of unwanted mist, resulting in poor traveling of the droplet ejected from the nozzle into the air and poor landing of the droplet onto a target surface.

However, in general, there is a limit in the response speed and operation speed of an actuator configured to change the pressure inside a liquid compartment. For example, it is difficult to drive a piezoelectric element used as the actuator in JP-A-2010-274446 mentioned above at a cycle shorter than its natural cycle. As described above, in a liquid discharging apparatus, there is still a room for enhancing controllability in discharging a liquid from a nozzle by controlling the pressure inside a liquid compartment more appropriately and for enhancing reliability in discharging the liquid by keeping a state of discharging the liquid good. The problem described above applies not only to a liquid discharging apparatus using a piezoelectric element as an actuator for changing the pressure inside a liquid compartment but also to a liquid discharging apparatus using other kind of actuator for changing the pressure inside a liquid compartment.

SUMMARY

Some aspects of the invention can be embodied as follows.

[1] In one aspect of the invention, a liquid discharging apparatus is provided. The liquid discharging apparatus includes: a liquid compartment that contains a liquid; a flowing-in passage that is in communication with the liquid compartment through a flowing-in opening for the liquid compartment, the liquid flowing through the flowing-in passage into the liquid compartment; a nozzle that is in communication with the liquid compartment through a communication opening for the liquid compartment, the liquid contained in the liquid compartment being discharged from the nozzle; a capacity changer that causes the liquid to be discharged from the nozzle by causing a displacement (change in position) of an inner wall surface of the liquid component and changing capacity of the liquid compartment; and a flowing-in passage resistance changer that changes capacity of the flowing-in passage to change flow resistance of the flowing-in passage. In the liquid compartment, the communication opening is located at a side where the flowing-in opening is provided with respect to a center-of-displacement portion, an amount of the displacement of which is largest in the inner wall surface displaced by the capacity changer. In the liquid discharging apparatus of this aspect, since the communication opening that is in communication with the nozzle is located relatively near the flowing-in opening, it is easier for a pressure change caused by the driving of the flowing-in passage resistance changer to reach the nozzle. Therefore, it is possible to produce a pressure change for discharging the liquid from the nozzle not only by the driving of the capacity changer but also by the driving of the flowing-in passage resistance changer. Therefore, with the coordinated operation of the capacity changer and the flowing-in passage resistance changer, it is possible to control the pressure change for discharging the liquid from the nozzle with higher precision. Consequently, it is possible to enhance controllability and reliability in discharging the liquid from the nozzle by the liquid discharging apparatus.

[2] In the liquid discharging apparatus of the above aspect, in the liquid compartment, within an area located closer to the flowing-in opening than the center-of-displacement portion is, the communication opening may be located closer to the flowing-in opening than to the center-of-displacement portion. This preferred liquid discharging apparatus further makes it easier for the pressure change caused by the driving of the flowing-in passage resistance changer to reach the nozzle.

[3] In the liquid discharging apparatus of the above aspect, in the liquid compartment, within an area located closer to the flowing-in opening than the center-of-displacement portion is, the communication opening may be located closer to the center-of-displacement portion than to the flowing-in opening. This preferred liquid discharging apparatus makes it easier for, when the liquid is discharged from the nozzle, the pressure change caused by the driving of the capacity changer to reach the nozzle.

[4] The liquid discharging apparatus of the above aspect may further include: a flowing-out passage through which the liquid flows out from the liquid compartment. This preferred liquid discharging apparatus makes it possible to produce a flow of the liquid from the flowing-in passage toward the flowing-out passage in the liquid compartment, thereby preventing the liquid from stagnating inside the liquid compartment. Moreover, it is possible to cause air bubbles produced as a result of entry of external air into the liquid compartment to flow out through the flowing-out passage. Therefore, the risk of occurrence of poor discharging caused by the stagnation of the liquid inside the liquid compartment or by the presence of air bubbles inside the liquid compartment decreases, resulting in enhanced reliability in discharging the liquid.

[5] The preferred liquid discharging apparatus may further include: a circulation passage for circulation, to the liquid compartment, of the liquid flowing out through the flowing-out passage. This preferred liquid discharging apparatus makes it possible to prevent the liquid from stagnating inside the liquid compartment by produce the flow of the liquid from the flowing-in passage toward the flowing-out passage in the liquid compartment and to avoid wasteful consumption of the liquid flowing out through the flowing-out passage.

[6] The liquid discharging apparatus of the above aspect may further include: a controller that controls the capacity changer and the flowing-in passage resistance changer, and executes discharge processing for discharging the liquid in a form of a droplet from the nozzle, wherein, in the discharge processing, the controller may cause the liquid to start going out from the nozzle by causing the capacity changer to decrease the capacity of the liquid compartment, and cause the flowing-in passage resistance changer to increase the capacity of the flowing-in passage during the going out of the liquid from the nozzle so as to separate the droplet from the liquid of the nozzle and release the droplet into air. This preferred liquid discharging apparatus makes it possible to produce a suction force for sucking the liquid going out through the communication opening back toward the flowing-in opening by increasing the capacity of the flowing-in passage during the discharging of the liquid from the nozzle. The suction force facilitates the separation, from the liquid in the nozzle, of the liquid going out from the nozzle, and reduces the risk of occurrence of poor discharging caused by a phenomenon of wastefully forming a tail by the liquid discharged from the nozzle. Since it is possible to produce the force for discharging the liquid from the nozzle and the force for releasing the droplet from the nozzle by means of different drive units, that is, the capacity changer and the flowing-in passage resistance changer, resulting in enhanced controllability in the pressure change inside the liquid compartment in discharge processing.

[7] In the preferred liquid discharging apparatus, in the discharge processing, before causing the capacity changer to decrease the capacity of the liquid compartment so as to cause the liquid to start going out from the nozzle, the controller may cause the flowing-in passage resistance changer to increase the flow resistance of the flowing-in passage. This preferred liquid discharging apparatus makes it possible to prevent the pressure produced due to the driving of the capacity changer for discharging the liquid from escaping into the flowing-in passage.

[8] The preferred liquid discharging apparatus may further include: a flowing-out passage resistance changer that changes capacity of the flowing-out passage to change flow resistance of the flowing-in passage; and a controller that controls the capacity changer, the flowing-in passage resistance changer, and the flowing-out passage resistance changer, and executes discharge processing for discharging the liquid in a form of a droplet from the nozzle, wherein, in the discharge processing, the controller may cause the liquid to start going out from the nozzle by causing the capacity changer to decrease the capacity of the liquid compartment, and cause the flowing-in passage resistance changer to increase the capacity of the flowing-in passage during the going out of the liquid from the nozzle so as to separate the droplet from the liquid of the nozzle and release the droplet into air; and wherein, in the discharge processing, before causing the capacity changer to decrease the capacity of the liquid compartment so as to cause the liquid to start going out from the nozzle, the controller may cause the flowing-in passage resistance changer to increase the flow resistance of the flowing-in passage and causes the flowing-out passage resistance changer to increase the flow resistance of the flowing-out passage. This preferred liquid discharging apparatus makes it possible to produce, in discharge processing, the force for discharging the liquid from the nozzle and the force for releasing the droplet from the nozzle by means of different drive units, that is, the capacity changer and the flowing-in passage resistance changer. Therefore, controllability in the pressure change inside the liquid compartment in discharge processing enhances. Moreover, it is possible to prevent the pressure produced due to the driving of the capacity changer for discharging the liquid from escaping into the flowing-in passage and the flowing-out passage when the liquid is discharged from the nozzle.

[9] In the preferred liquid discharging apparatus, the controller may cause the capacity changer to increase the capacity of the liquid compartment in a process of causing the flowing-in passage resistance changer to decrease the capacity of the flowing-in passage. This preferred liquid discharging apparatus makes it possible to prevent the liquid forced out due to the decrease in the capacity of the flowing-in passage from leaking out from the nozzle before the start of discharging of the liquid from the nozzle. Therefore, poor discharging of the liquid due to unwanted leakage of the liquid from the nozzle is suppressed.

Not all of plural elements of each exemplary mode of the invention described above are essential. In order to solve a part or a whole of the problems described above, or in order to achieve a part or a whole of effects described in this specification, a part of the plural elements may be changed, deleted, or replaced with any other new element, or a part of limitations may be deleted. In order to solve a part or a whole of the problems described above, or in order to achieve a part or a whole of effects described in this specification, a part or a whole of technical features included in one of the modes of the invention described above may be combined with a part or a whole of technical features included in another to derive an independent mode of the invention.

The invention can be embodied not only as a liquid discharging apparatus but also in various other forms. For example, it may be embodied as a liquid discharging system, a head of a liquid discharging apparatus, a method for controlling a liquid discharging apparatus, system, head, a computer program for implementation of such a control method, and/or a non-transitory storage medium storing such a computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
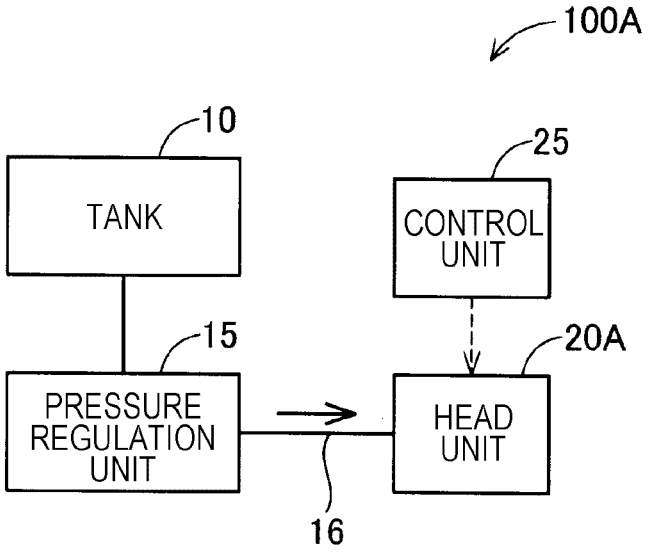
FIG. 1 is a schematic block diagram that illustrates the configuration of a liquid discharging apparatus according to a first embodiment.

FIG. 1 is a schematic block diagram that illustrates the overall configuration of a liquid discharging apparatus 100A according to a first embodiment. The liquid discharging apparatus 100A includes a tank 10, a pressure regulation unit 15, a supply passage 16, a head unit 20A, and a control unit 25.

A liquid is contained in the tank 10. The liquid is, for example, ink that has predetermined viscosity. The liquid contained in the tank 10 is supplied to the head unit 20A through the supply passage 16, which is connected to the head unit 20A.

The pressure regulation unit 15 is provided on the supply passage 16. The pressure regulation unit 15 adjusts the pressure of the liquid supplied to the head unit 20A through the supply passage 16 into predetermined pressure. The pressure regulation unit 15 is, for example, a pump for sucking the liquid out of the tank 10, or a valve that opens and closes so as to adjust pressure at the side where the head unit 20A is provided into predetermined pressure (not illustrated). The head unit 20A discharges the liquid supplied through the supply passage 16. The operation of the head unit 20A is controlled by the control unit 25. The structure of the head unit 20A will be described later.

The control unit 25 is, for example, a computer that includes a CPU and a memory. Various functions for controlling the liquid discharging apparatus 100A are realized by reading out, and executing, a control program and control instructions that are stored in the memory by the CPU. The control program may be stored in various kinds of non-transitory tangible storage medium. The control unit 25 may be configured as circuitry.

Figure 2:
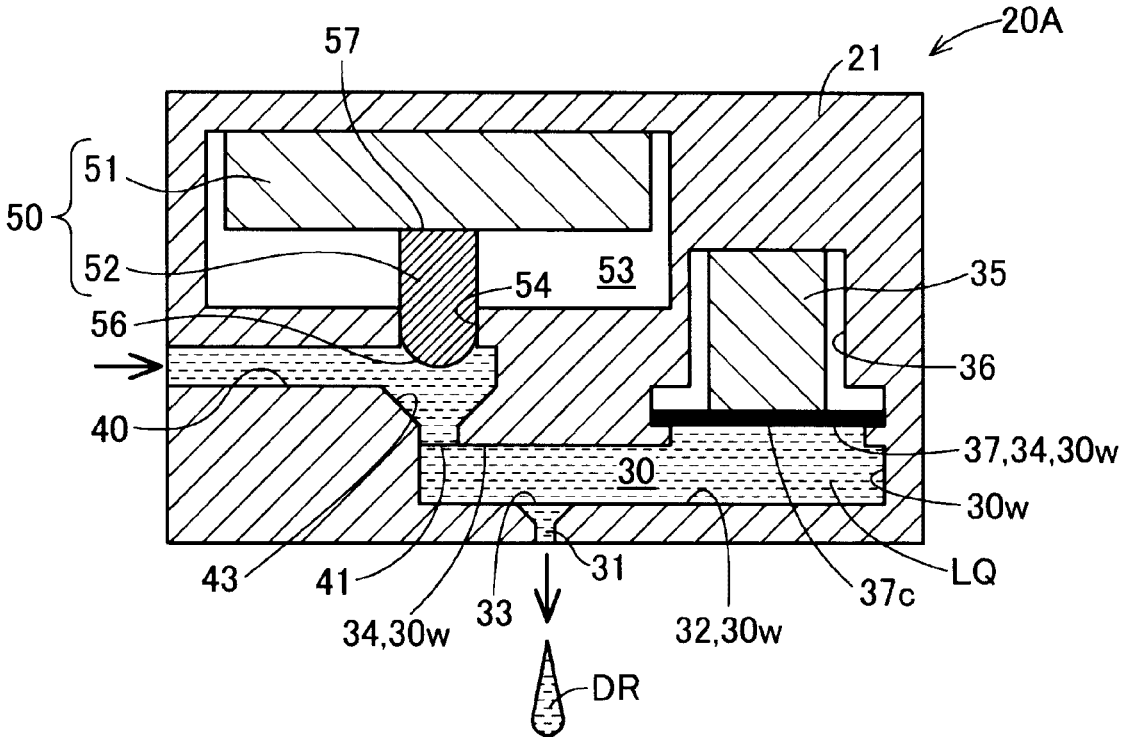
FIG. 2 is a schematic sectional view of the internal structure of a head unit according to the first embodiment.

FIG. 2 is a schematic sectional view of the internal structure of the head unit 20A. The cross-sectional structure of the head unit 20A taken along a cross-sectional plane passing through the center axis (not illustrated) of a nozzle 31 and through a flowing-in passage 40 is schematically illustrated in FIG. 2. The head unit 20A includes a liquid compartment 30, the nozzle 31, and the flowing-in passage 40.

The liquid compartment 30 is formed inside a casing 21 of the head unit 20A. The casing 21 is made of metal. The liquid compartment 30 is a room surrounded by inner wall surfaces 30*w* and has a space for containing a liquid LQ. The liquid LQ contained in the liquid compartment 30 is discharged to the outside of the head unit 20A in the form of a liquid droplet DR. The nozzle 31 is formed as a through hole that goes through the casing 21 of the head unit 20A. The nozzle 31 is in communication with the liquid compartment 30 through a communication opening 33 formed in the floor surface 32, which is one of the inner wall surfaces 30*w* of the liquid compartment 30. In the first embodiment, the nozzle 31 has an opening oriented in the direction of gravity. The head unit 20A may include two or more nozzles 31 and two or more liquid compartments 30.

The flowing-in passage 40 is a flow passage formed inside the casing 21 of the head unit 20A for the liquid LQ. The flowing-in passage 40 is in communication with the liquid compartment 30 through a flowing-in opening 41, which is open into the liquid compartment 30. The flowing-in passage 40 connects the supply passage 16 (FIG. 1) to the liquid compartment 30 such that the liquid LQ supplied through the supply passage 16 flows into the liquid compartment 30 through the flowing-in opening 41. In the first embodiment, the flowing-in passage 40 is in communication with the liquid compartment 30 from above, and the flowing-in opening 41 is formed in the ceiling surface 34 of the liquid compartment 30 and is open in the direction of gravity.

The head unit 20A further includes a capacity changing unit 35 and a flowing-in passage resistance changing unit 50. Under the control of the control unit 25 (FIG. 1), the capacity changing unit 35 changes the capacity of the liquid compartment 30, thereby causing the liquid LQ to be discharged from the nozzle 31 in the form of a droplet DR. The capacity changing unit 35 is housed in a first drive chamber 36. The first drive chamber 36 is a room formed over the liquid compartment 30 inside the casing 21 of the head unit 20A. The liquid compartment 30 and the first drive chamber 36 are partitioned and hermetically separated from each other by a diaphragm 37.

The diaphragm 37 constitutes a part of the ceiling surface 34, which is one of the inner wall surfaces 30*w* of the liquid compartment 30. In the first embodiment, the diaphragm 37 is a membrane-type member that is thin and is made of metal. The diaphragm 37 may be a member that is made of other thin, flexible, and deformable film-like material, for example, an elastic rubber membrane.

The capacity changing unit 35 is connected to the upper surface of the diaphragm 37 and causes deformation by applying an external force to the diaphragm 37. In the first embodiment, the capacity changing unit 35 is made of a piezoelectric element and is configured to cause vertical deformation of the diaphragm 37 due to its own change in shape in the vertical direction, that is, expansion/contraction. As mentioned above, the diaphragm 37 constitutes a part of one of the inner wall surfaces 30*w* of the liquid compartment 30. The capacity of the liquid compartment 30 changes when the diaphragm 37 becomes deformed. As described above, the capacity changing unit 35 changes the capacity of the liquid compartment 30 by causing a displacement, in the vertical direction, of the diaphragm 37, which constitutes a part of the ceiling surface 34 of the liquid compartment 30.

An example of a flat state of the diaphragm 37, meaning that it is not deformed, is illustrated in FIG. 2. The length of the capacity changing unit 35 in the expanding/contracting direction when in this state is hereinafter referred to as "reference length", and the capacity of the liquid compartment 30 when in this state is hereinafter referred to as "reference capacity". The capacity of the liquid compartment 30 decreases from the reference capacity when the capacity changing unit 35 expands to increase its length from the reference length. The capacity of the liquid compartment 30 increases from the reference capacity when the capacity changing unit 35 contracts to decrease its length from the reference length.

The flowing-in passage resistance changing unit 50 is provided on the flowing-in passage 40. Under the control of the control unit 25 (FIG. 1), the flowing-in passage resistance changing unit 50 changes the flow resistance of the flowing-in passage 40 by changing the capacity of the flowing-in passage 40, thereby controlling the flow of the liquid LQ between the liquid compartment 30 and the flowing-in passage 40. The flowing-in passage resistance changing unit 50 includes a driver portion 51 and a valve member 52.

The driver portion 51 is housed in a second drive chamber 53. The second drive chamber 53 is a room formed inside the casing 21 of the head unit 20A. In the first embodiment, the second drive chamber 53 is located over the flowing-in passage 40. In addition, the second drive chamber 53 is located adjacent to the first drive chamber 36 in the horizontal direction over the liquid compartment 30. The flowing-in passage 40 and the second drive chamber 53 are spatially connected to each other via a through hole 54 going straight therebetween.

The valve member 52 is a columnar member made of metal. The valve member 52 is provided across a wall portion located between the flowing-in passage 40 and the second drive chamber 53 through the through hole 54 mentioned above. That is, the valve member 52 has one end portion in the flowing-in passage 40 and the other end portion in the second drive chamber 53. The end portion in the flowing-in passage 40 is hereinafter referred to as "head end portion 56". The end portion in the second drive chamber 53 is hereinafter referred to as "tail end portion 57". In the first embodiment, the valve member 52 is oriented such that the head end portion 56 is directed toward the bottom and the tail end portion 57 is directed toward the top, meaning that its length direction coincides with the direction of gravity. In the first embodiment, the head end portion 56 of the valve member 52 is formed as a hemispherical convex portion. It can be construed that, of the valve member 52, the surface of the portion located inside the flowing-in passage 40 constitutes a part of an inner wall surface of the flowing-in passage 40.

The driver portion 51 is connected to the tail end portion 57 of the valve member 52. The driver portion 51 applies an external force to the valve member 52 to change the position of the valve member 52 along its length direction. In the first embodiment, the driver portion 51 is made of a piezoelectric element and is configured to expand and contract in the vertical direction inside the second drive chamber 53, thereby causing the valve member 52 to move up and down like a piston. A sealing member (not illustrated) that is in contact with the side surface of the valve member 52 so as to keep the second drive chamber 53 hermetically sealed is provided inside the through hole 54. The valve member 52 moves for a piston motion while sliding along the inner circumferential surface of the sealing member.

An example of a state of contraction of the driver portion 51, with the length of protrusion of the valve member 52 into the flowing-in passage 40 minimized, is illustrated in FIG. 2. The valve member 52 moves down to increase the length of its protrusion into the flowing-in passage 40 and to decrease the capacity of the flowing-in passage 40 when the driver portion 51 expands from this state. Since the flowing-in passage resistance changing unit 50 operates as described above, the capacity of the flowing-in passage 40 decreases due to the expansion of the driver portion 51, resulting in an increase in the flow resistance of the flowing-in passage 40. Conversely, the capacity of the flowing-in passage 40 increases when the driver portion 51 contracts, resulting in a decrease in the flow resistance of the flowing-in passage 40.

In the first embodiment, the flowing-in passage 40 has a valve seat portion 43. The valve seat portion 43 is provided at a position where it faces the head end portion 56 of the valve member 52. The valve seat portion 43 is formed as a tapered portion whose diameter decreases gradually in the direction of movement when the valve member 52 moves in such a way as to protrude further into the flowing-in passage 40. In the first embodiment, the flowing-in opening 41 is provided under the valve seat portion 43. When the length of protrusion of the valve member 52 into the flowing-in passage 40 is maximized, the head end portion 56 of the valve member 52 comes into contact with the inner wall surface of the valve seat portion 43 to close the flowing-in passage 40. As described above, in the first embodiment, the flowing-in passage resistance changing unit 50 is configured to close the flowing-in passage 40 by moving the valve member 52 in the direction of increasing the flow resistance of the flowing-in passage 40. The flowing-in passage resistance changing unit 50 is configured to open the flowing-in passage 40 by moving the valve member 52 in the direction of decreasing the flow resistance of the flowing-in passage 40.

In the first embodiment, the amount of expansion/contraction of the driver portion 51 of the flowing-in passage resistance changing unit 50 is larger than the amount of expansion/contraction of the capacity changing unit 35. For example, the amount of expansion/contraction of the driver portion 51 of the flowing-in passage resistance changing unit 50 may be several to dozens of times as large as the amount of expansion/contraction of the capacity changing unit 35. In the first embodiment, for the purpose of preventing the driver portion 51 of the flowing-in passage resistance changing unit 50, the amount of expansion/contraction of which is large, from buckling due to its expansion/contraction, the width of the driver portion 51 in the direction orthogonal to the expanding/contracting direction of the driver portion 51 is designed to be greater than that of the capacity changing unit 35.

In the head unit 20A according to the first embodiment, in the liquid compartment 30, the communication opening 33 of the nozzle 31 is located at the side where the flowing-in opening 41 is provided with respect to the center-of-displacement portion 37*c*, more specifically, as compared with the center of the displacement, by the capacity changing unit 35, of the diaphragm 37, which constitutes a part of the inner wall surface 30*w*. The center-of-displacement portion 37*c* is, of the diaphragm 37, a portion at which the amount of displacement is the largest. In the first embodiment, the head end portion of the capacity changing unit 35 in contact with the diaphragm 37 has a flat face. Therefore, the center-of-displacement portion 37*c* is an area where the diaphragm 37 is in contact with the head end face of the capacity changing unit 35. In a case where the head end portion of the capacity changing unit 35 in contact with the diaphragm 37 has a hemispherical shape or where the head end portion of the capacity changing unit 35 has a protrusion extending therefrom on the center axis of the capacity changing unit 35, the center-of-displacement portion 37*c* is a portion where the center axis of the capacity changing unit 35 intersects with the diaphragm 37.

As described above, in the head unit 20A according to the first embodiment, the communication opening 33 of the nozzle 31 is located closer to the flowing-in opening 41 of the flowing-in passage 40. This structure makes it easier for a pressure change caused inside the flowing-in passage 40 due to the operation of changing the capacity of the flowing-in passage 40 by the flowing-in passage resistance changing unit 50 to reach the nozzle 31 corresponding to the liquid compartment 30 and thus makes it possible to utilize the pressure change as a driving force for ejecting a liquid droplet DR from the nozzle 31. Therefore, it is possible to perform finer control on the timing of pressure generation for discharging a liquid droplet DR from the nozzle 31 by driving the flowing-in passage resistance changing unit 50 in tandem with the capacity changing unit 35 in a coordinated manner. Consequently, it is possible to enhance controllability and reliability in discharging a liquid droplet DR by the liquid discharging apparatus 100A. An example of discharge processing executed by the liquid discharging apparatus 100A for ejecting a liquid droplet DR will be described later.

In the first embodiment, the communication opening 33 of the nozzle 31 is located away from the area under the diaphragm 37. In addition, in the first embodiment, in the liquid compartment 30, within the area located closer to the flowing-in opening 41 than the center-of-displacement portion 37*c* is, the communication opening 33 is located closer to the flowing-in opening 41 than to the center-of-displacement portion 37*c*. This structure further makes it easier for a pressure change caused by the operation performed by the flowing-in passage resistance changing unit 50 to reach the nozzle 31.

In the head unit 20A according to the first embodiment, the capacity changing unit 35 and the flowing-in passage resistance changing unit 50 are arranged with chamber adjacency in the horizontal direction over the liquid compartment 30. In addition, in the head unit 20A according to the first embodiment, as viewed in the horizontal direction, the communication opening 33 of the nozzle 31 is provided at a shifted position away from the area where the capacity changing unit 35 is provided toward the area where the driver portion 51 of the flowing-in passage resistance changing unit 50 is provided.

Since the head unit 20A according to the first embodiment has the structure described above, even if the size of the driver portion 51 in the width direction is increased to the limit in such a way as not to interfere with the area where the capacity changing unit 35 is provided, it is still possible to provide the nozzle 31 at a position where a pressure change caused by the operation performed by the flowing-in passage resistance changing unit 50 reaches easily. Therefore, it is possible to increase the size of the driver portion 51 so as to prevent the driver portion 51 from buckling due to its expansion/contraction, thereby increasing its durability.

Figure 3:
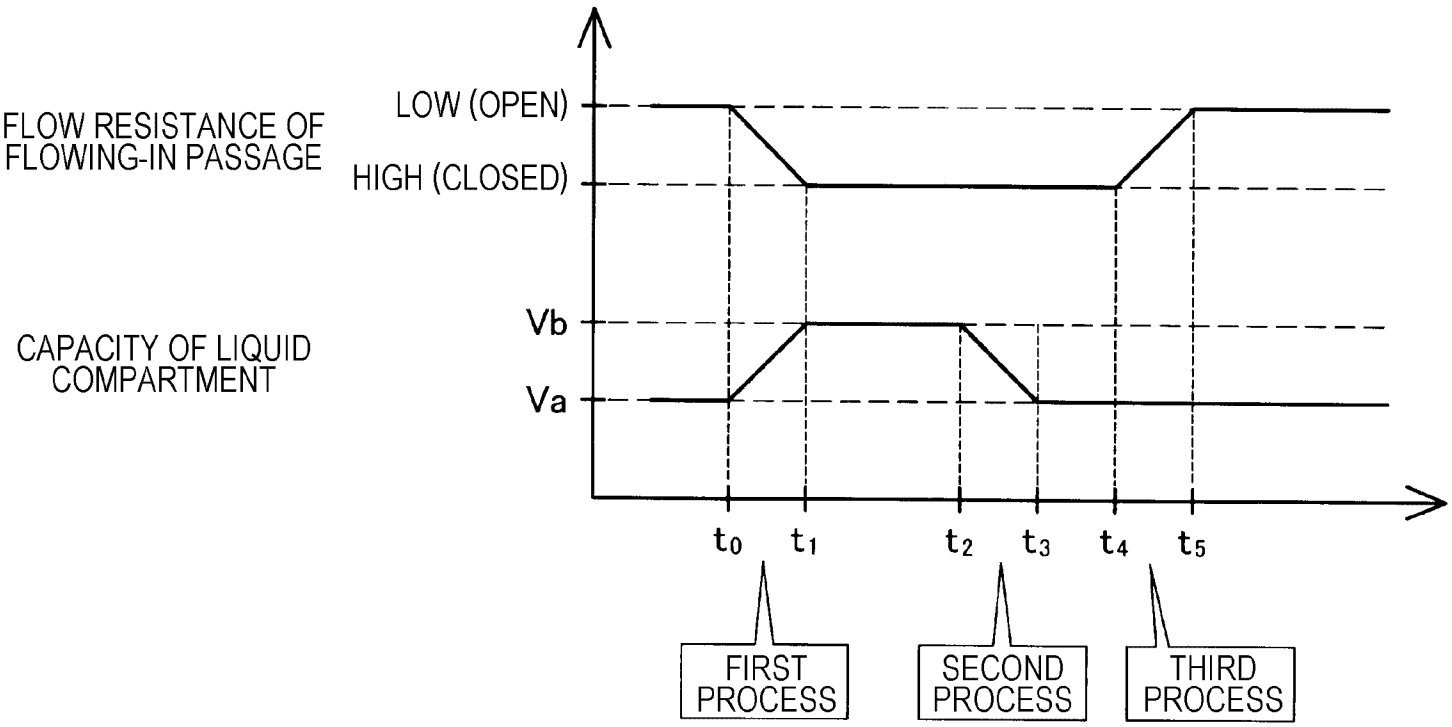
FIG. 3 is a timing chart of discharge processing according to the first embodiment.
Figure 4A:
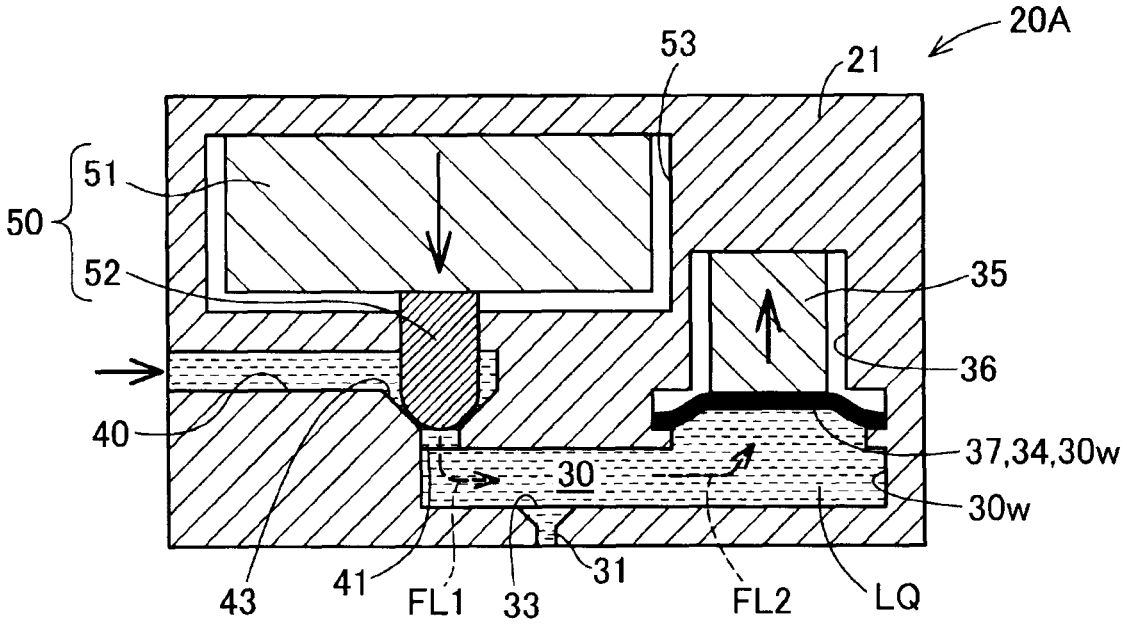
FIG. 4A is a first schematic view of operation of the head unit in discharge processing according to the first embodiment.
Figure 4B:
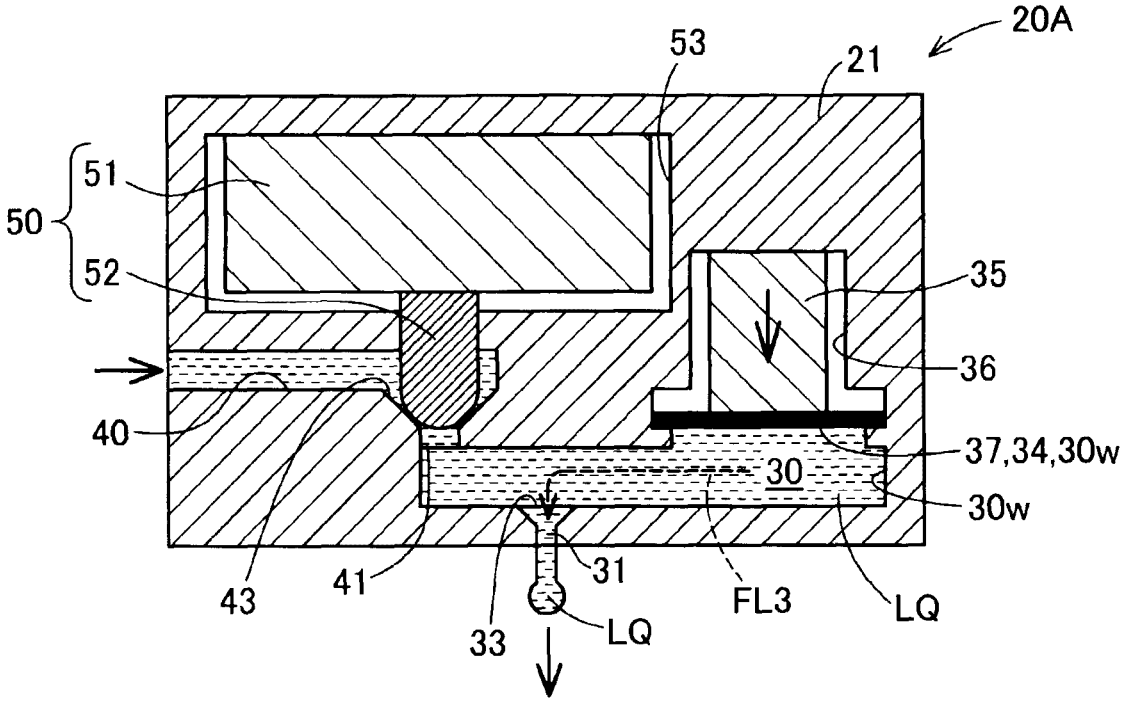
FIG. 4B is a second schematic view thereof.
Figure 4C:
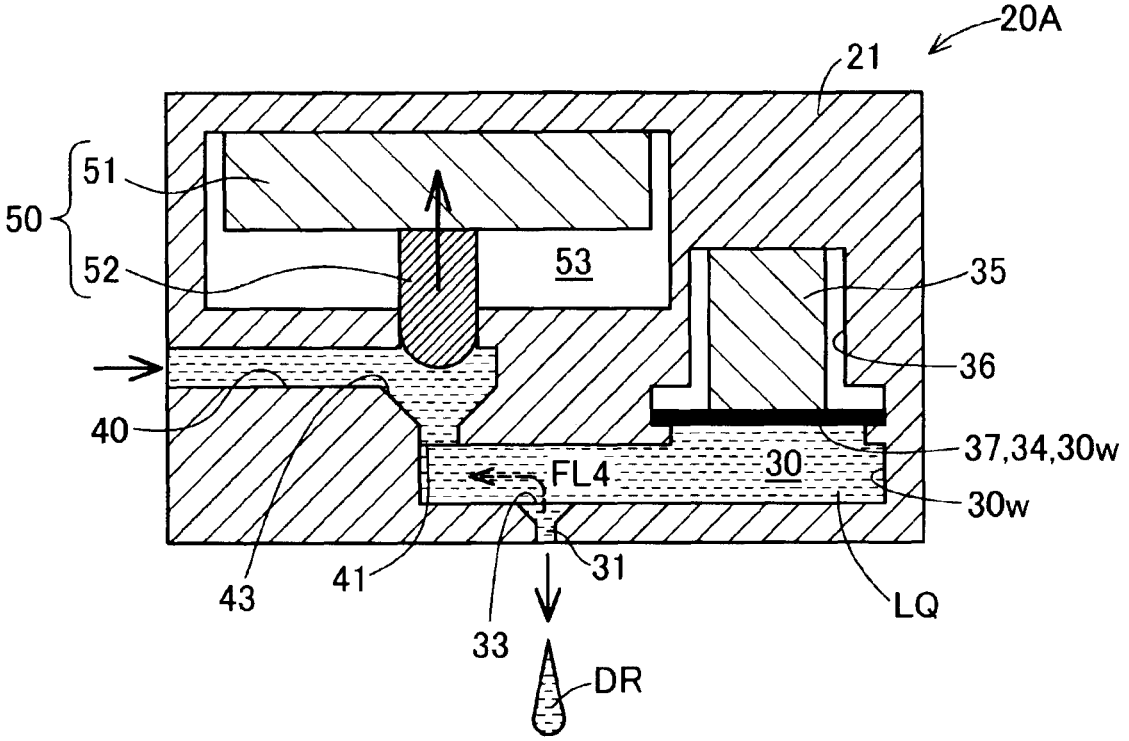
FIG. 4C is a third schematic view thereof.

With reference to FIGS. 2, 3, 4A, 4B, and 4C, a preferred example of discharge processing, suitable for the liquid discharging apparatus 100A for ejecting a liquid droplet DR, will now be explained. FIG. 3 is a timing chart that illustrates the timing of changing the capacity of the liquid compartment 30 by the capacity changing unit 35 and the timing of changing the flow resistance of the flowing-in passage 40 by the flowing-in passage resistance changing unit 50. FIGS. 4A, 4B, and 4C are schematic diagrams that illustrate, in time series, the operation of the head unit 20A in discharge processing according to the first embodiment.

Before starting the execution of discharge processing for ejecting a liquid droplet DR from the nozzle 31, the control unit 25 puts the head unit 20A into an initial state illustrated in FIG. 2. In the initial state, the control unit 25 commands the pressure regulation unit 15 (FIG. 1) to adjust the pressure of the liquid compartment 30 into predetermined reference pressure that is not in excess of the withstanding pressure of the meniscus of the nozzle 31. Moreover, the control unit 25 sets the capacity of the liquid compartment 30 into the aforementioned reference capacity, and causes the flowing-in passage resistance changing unit 50 to put the flowing-in passage 40 into an open state. In FIG. 3, the reference capacity is denoted as Va.

With reference to FIGS. 3 and 4A, a first process of discharge processing will now be explained. First, the control unit 25 causes the flowing-in passage resistance changing unit 50 to close the flowing-in passage 40 and increase the flow resistance of the flowing-in passage 40 (from a point in time $t_0$ to a point in time $t_1$ in FIG. 3). In addition to causing the flowing-in passage resistance changing unit 50 to decrease the capacity of the flowing-in passage 40, the control unit 25 causes the capacity changing unit 35 to deform the diaphragm 37 upward, thereby increasing the capacity of the liquid compartment 30 from the reference capacity Va to capacity Vb. The capacity Vb is hereinafter referred to as "before-discharge capacity Vb".

Due to the decrease in the capacity of the flowing-in passage 40 by the flowing-in passage resistance changing unit 50, as indicated by a broken-line arrow FL1 in FIG. 4A, some liquid LQ whose amount corresponds to the decrease in the capacity of the flowing-in passage 40 is forced into the liquid compartment 30. On the other hand, the capacity changing unit 35 increases the capacity of the liquid compartment 30 to the before-discharge capacity Vb so as to produce, in the liquid compartment 30, a buffer space for making it possible to accommodate the liquid LQ corresponding to the amount forced out of the flowing-in passage 40, as indicated by a broken-line arrow FL2 in FIG. 4A. By this means, it is possible to avoid the meniscus of the nozzle 31 from being destroyed as a result of the operation of decreasing the capacity of the flowing-in passage 40 by the flowing-in passage resistance changing unit 50, thereby avoiding the liquid LQ from flowing out from the nozzle 31.

Preferably, the increase from the reference capacity Va to the before-discharge capacity Vb should be not less than the volume of the liquid LQ that would flow out through the communication opening 33 if the open flowing-in passage 40 were closed without driving the capacity changing unit 35 at all in a state in which the liquid compartment 30 is filled with the liquid LQ. In the first process, the timing and/or speed of increasing the capacity of the liquid compartment 30 by the capacity changing unit 35 and the timing and/or speed of decreasing the capacity of the flowing-in passage 40 by the flowing-in passage resistance changing unit 50 may be different from each other. The timing and/or speed thereof may have been determined in advance on the basis of the type of the liquid LQ, the shape of the flow passage inside the head unit 20A for the liquid LQ, and/or the like.

Next, with reference to FIGS. 3 and 4B, a second process of discharge processing will now be explained. In the second process (from a point in time $t_2$ to a point in time $t_3$ in FIG. 3), the control unit 25 causes the capacity changing unit 35 to decrease the capacity of the liquid compartment 30, thereby causing the liquid LQ to start going out from the nozzle 31. Specifically, after a lapse of predetermined time from the point in time $t_1$, the control unit 25 causes the capacity changing unit 35 to expand instantaneously to decrease the capacity of the liquid compartment 30. The period $t_1$ to $t_2$ before the start of the second process is not shorter than the natural cycle of the capacity changing unit 35. In the first embodiment, the capacity of the liquid compartment 30 is decreased to the reference capacity Va in the second process.

The pressure of the liquid compartment 30 increases due to the decrease in the capacity of the liquid compartment 30 during the time $t_2$-$t_3$. Therefore, as indicated by a broken-line arrow FL3 in FIG. 4B, the liquid LQ contained in the liquid compartment 30 is forced toward the nozzle 31, and starts going out from the nozzle 31. In the second process, the capacity of the liquid compartment 30 does not have to be necessarily decreased until reaching the reference capacity Va. Alternatively, the capacity of the liquid compartment 30 may be decreased to a capacity value that is less than the reference capacity Va. The amount of the reduction in the capacity of the liquid compartment 30 may be determined depending on the intended size of a liquid droplet DR.

In the first embodiment, before the second process, the capacity of the flowing-in passage 40 was decreased by the flowing-in passage resistance changing unit 50 in the first process described above. That is, in preparation for starting the outputting (going out) of the liquid LQ from the nozzle 31, the control unit 25 caused the flowing-in passage resistance changing unit 50 to decrease the capacity of the flowing-in passage 40 before causing the capacity changing unit 35 to decrease the capacity of the liquid compartment 30. Since the flowing-in passage 40 has been put into a state of high flow resistance by the flowing-in passage resistance changing unit 50 in advance, the pressure increased by the capacity changing unit 35 in the second process does not escape into the flowing-in passage 40. Therefore, it is possible to efficiently transmit, to the nozzle 31, the pressure for causing the liquid LQ to go out from the nozzle 31.

Next, with reference to FIGS. 3 and 4C, a third process of discharge processing will now be explained. After causing the capacity changing unit 35 to decrease the capacity of the liquid compartment 30, the control unit 25 causes the flowing-in passage resistance changing unit 50 to increase the capacity of the flowing-in passage 40 during the going out of the liquid LQ from the nozzle 31 (from a point in time $t_4$ to a point in time $t_5$ in FIG. 3). The phrase "during the going out of the liquid LQ from the nozzle 31" used here means the duration of a state of the liquid LQ going out from the nozzle 31 in such a way as to form a tail.

Due to the increase in the capacity of the flowing-in passage 40, as indicated by a broken-line arrow FL4 in FIG. 4C, temporarily, pressure that acts in a direction of sucking the liquid LQ toward the flowing-in passage 40 is produced inside the liquid compartment 30. This pressure acts in a direction of separating, from the liquid LQ retained at the nozzle 31, the liquid LQ going out from the nozzle 31. Consequently, a liquid droplet DR separated from the liquid LQ of the nozzle 31 is released into the air.

As described earlier, in the head unit 20A according to the first embodiment, the nozzle 31 is provided relatively near the flowing-in opening 41 of the flowing-in passage 40. This structure makes it easier for the above-mentioned pressure, which is produced by increasing the capacity of the flowing-in passage 40 in the third process and acts in the direction of sucking the liquid LQ contained in the liquid compartment 30 toward the flowing-in passage 40, to reach the liquid LQ of the nozzle 31. Therefore, performing the operation of increasing the capacity of the flowing-in passage 40 by the flowing-in passage resistance changing unit 50 makes it easier to release the liquid droplet DR from the liquid LQ of the nozzle 31.

In particular, in the first embodiment, since the communication opening 33 is located closer to the flowing-in opening 41 than to the center-of-displacement portion 37*c* of the diaphragm 37 as described earlier, it is easier for a pressure change caused by the operation performed by the flowing-in passage resistance changing unit 50 to reach and act on the nozzle 31. Therefore, it is possible to execute, more efficiently, the releasing of the liquid droplet D from the liquid LQ of the nozzle 31 due to the operation performed by the flowing-in passage resistance changing unit 50.

In the liquid discharging apparatus 100A according to the first embodiment, in discharge processing, the pressure change for releasing the liquid droplet D from the liquid LQ of the nozzle 31 is produced by the operation performed by the flowing-in passage resistance changing unit 50. Therefore, it is possible to produce the pressure change for releasing the liquid droplet D from the liquid LQ of the nozzle 31 at an earlier timing, shorter than the natural cycle of the capacity changing unit 35. As described above, it is possible to produce the pressure change for releasing the liquid droplet D from the liquid LQ of the nozzle 31 at a more suitable timing, regardless of the operation performance of the capacity changing unit 35, resulting in enhanced controllability in discharging the liquid droplet DR from the nozzle 31. Moreover, the timing of releasing the liquid droplet D from the liquid LQ of the nozzle 31 is controlled with higher precision, and such improved timing control makes it possible to prevent the liquid droplet D from wastefully forming a tail, prevent unwanted mist from being produced, prevent the liquid droplet D from being deformed, and so forth. Therefore, poor traveling of the liquid droplet D in the air and poor landing of the liquid droplet D onto a target surface are prevented, meaning enhanced reliability in discharging the liquid droplet DR by the head unit 20A.

As explained above, in the liquid discharging apparatus 100A according to the first embodiment, in the liquid compartment 30, the nozzle 31 is provided at a position where a pressure change caused by the operation performed by the flowing-in passage resistance changing unit 50 reaches easily. Therefore, with the coordinated operation of the capacity changing unit 35 and the flowing-in passage resistance changing unit 50, it is possible to control the discharging of the liquid droplet DR from the nozzle 31 more finely, resulting in enhanced controllability and enhanced reliability in discharging the liquid droplet DR by the head unit 20A. In addition to the above effects, the liquid discharging apparatus 100A according to the first embodiment produces various operational effects described in the first embodiment above.

B. Second Embodiment

Figure 5:
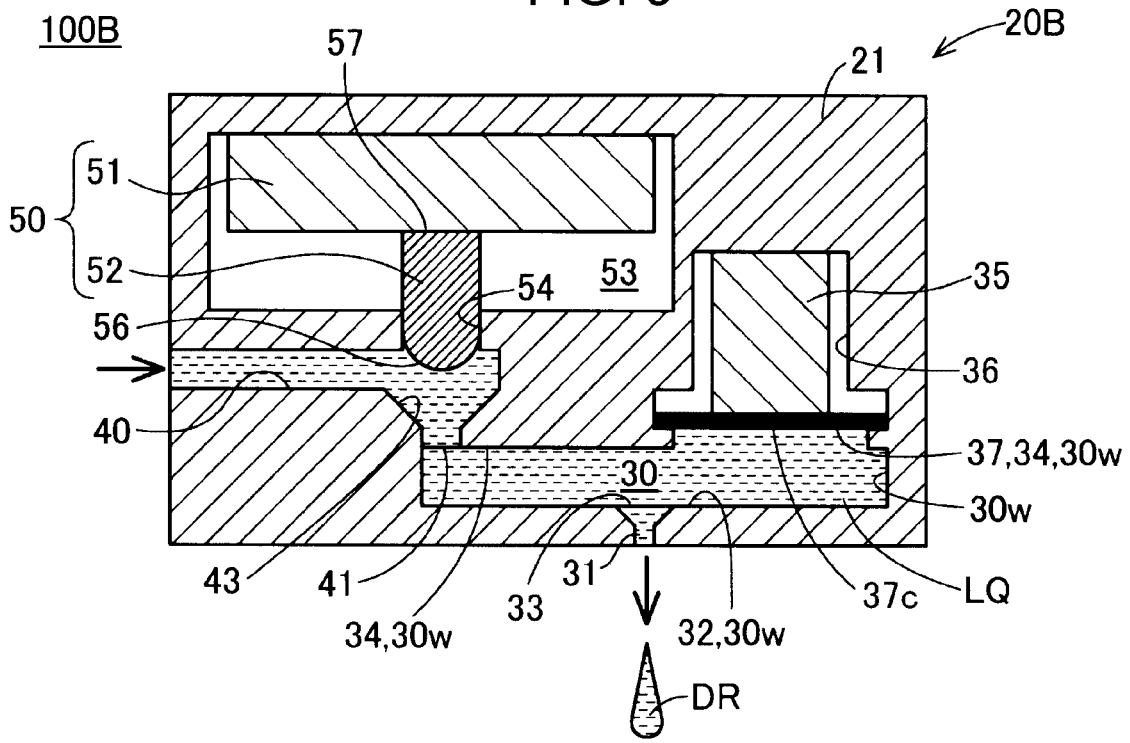
FIG. 5 is a schematic sectional view of the internal structure of a head unit according to a second embodiment.

FIG. 5 is a schematic sectional view of the internal structure of a head unit 20B of a liquid discharging apparatus 100B according to a second embodiment. The structure of the liquid discharging apparatus 100B according to the second embodiment is substantially the same as that of the liquid discharging apparatus 100A according to the first embodiment (FIG. 1), except that the head unit 20A according to the first embodiment is replaced with the head unit 20B according to the second embodiment. The structure of the head unit 20B according to the second embodiment is substantially the same as that of the head unit 20A according to the first embodiment (FIG. 2), except that, in the liquid compartment 30, the position where the nozzle 31 is formed and where its communication opening 33 is formed is different from the position in the first embodiment. In the liquid discharging apparatus 100B according to the second embodiment, the control unit 25 performs discharge processing similar to the discharge processing described in the first embodiment (FIG. 3).

In the head unit 20B according to the second embodiment, within the area located closer to the flowing-in opening 41 than the center-of-displacement portion 37*c* of the diaphragm 37 is, the communication opening 33 is located closer to the center-of-displacement portion 37*c* of the diaphragm 37 than to the flowing-in opening 41. Because of this structure, in the head unit 20B according to the second embodiment, it is easier for a pressure change caused by the capacity changing unit 35 to reach the nozzle 31 as compared with the head unit 20A according to the first embodiment. Therefore, it is possible to efficiently transmit, to the nozzle 31, the pressure generated by the capacity changing unit 35 for causing the liquid LQ to go out from the nozzle 31. In addition to the above effect, the liquid discharging apparatus 100B according to the second embodiment produces various operational effects that are similar to those described in the first embodiment.

C. Third Embodiment

Figure 6:
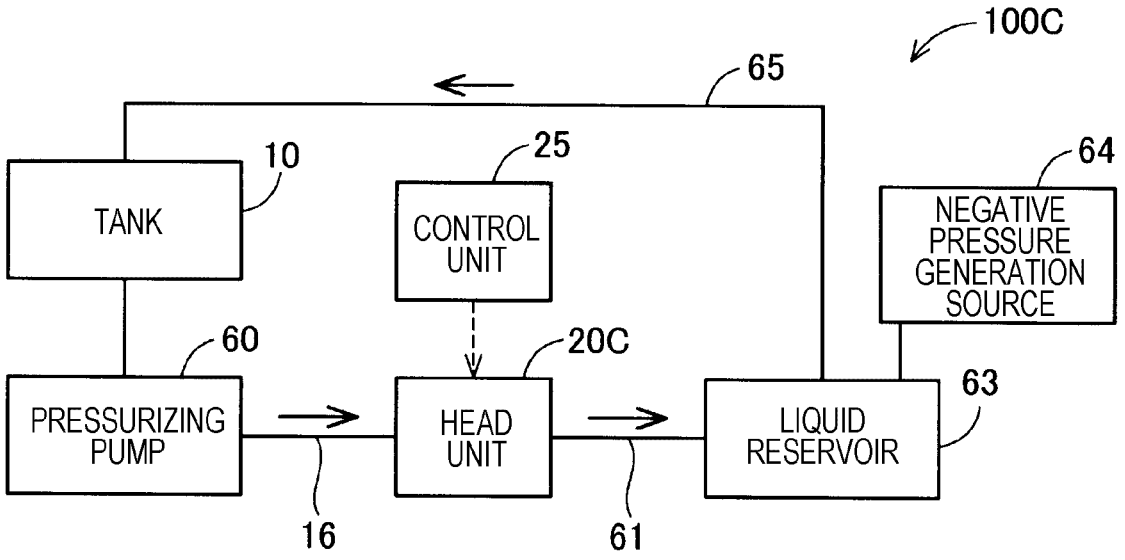
FIG. 6 is a schematic block diagram that illustrates the configuration of a liquid discharging apparatus according to a third embodiment.

FIG. 6 is a schematic block diagram that illustrates the overall configuration of a liquid discharging apparatus 100C according to a third embodiment. The structure of the liquid discharging apparatus 100C according to the third embodiment is substantially the same as that of the liquid discharging apparatus 100A according to the first embodiment (FIG. 1), except for the points of difference explained below. The liquid discharging apparatus 100C includes a pressurizing pump 60 in place of the pressure regulation unit 15, and includes a head unit 20C according to the third embodiment in place of the head unit 20A according to the first embodiment. Moreover, the liquid discharging apparatus 100C includes a drain passage 61, a liquid reservoir 63, a negative pressure generation source 64, and a circulation passage 65 additionally.

The pressurizing pump 60 operates to supply the liquid contained in the tank 10 to the head unit 20C through the supply passage 16. The structure of the head unit 20C will be described later. The drain passage 61 connects the head unit 20C to the liquid reservoir 63. The liquid that was not discharged by the head unit 20C is drained through the drain passage 61 into the liquid reservoir 63. The negative pressure generation source 64 is connected to the liquid reservoir 63. The negative pressure generation source 64 puts the internal pressure of the liquid reservoir 63 into negative pressure so as to suck the liquid out of the head unit 20C through the drain passage 61. Various kinds of pump can be used for the negative pressure generation source 64.

In the liquid discharging apparatus 100C, the pressurizing pump 60 and the negative pressure generation source 64 function as a liquid supply unit configured to supply the liquid to the head unit 20C by producing a pressure difference between the supply passage 16 and the drain passage 61. Either one of the pressurizing pump 60 and the negative pressure generation source 64 may be omitted so that either the pressurizing pump 60 alone or the negative pressure generation source 64 alone will behave as the liquid supply unit.

Figure 7:
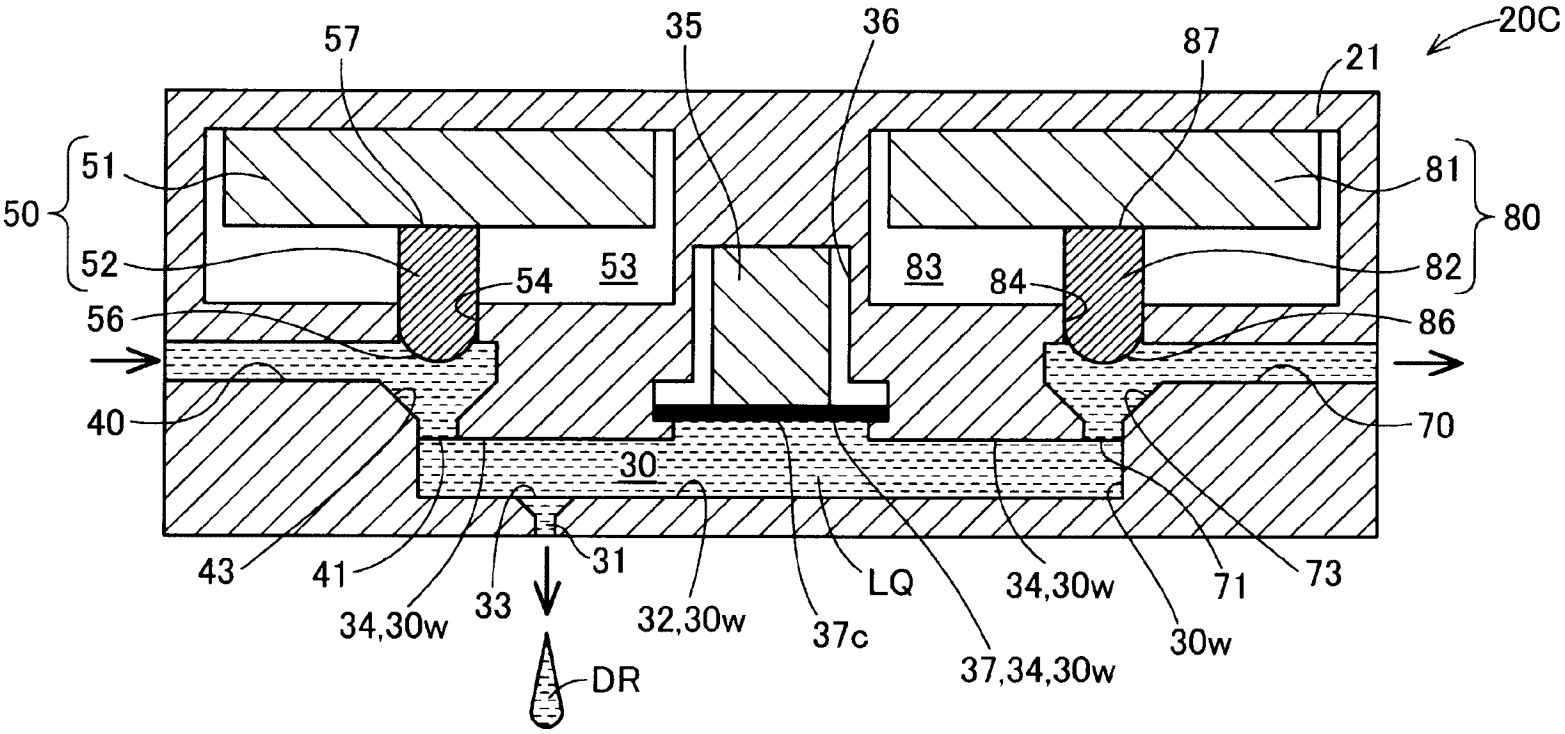
FIG. 7 is a schematic sectional view of the internal structure of a head unit according to the third embodiment.

The circulation passage 65 is a flow passage for circulation of the liquid flowing out through a flowing-out passage 70 of the head unit 20C back to the liquid compartment 30 of the head unit 20C. The circulation passage 65 connects the liquid reservoir 63 to the tank 10. The liquid having flowed out through the flowing-out passage 70 of the head unit 20C and thereafter having drained through the drain passage 61 into the liquid reservoir 63 is returned to the tank 10 through the circulation passage 65. Then, by means of the pressurizing pump 60, the returned liquid is supplied to the liquid compartment 30 of the head unit 20C again. The flowing-out passage 70 of the head unit 20C and the liquid compartment 30 of the head unit 20C are illustrated in FIG. 7, which will be referred to later. A pump for sucking the liquid out of the liquid reservoir 63 may be provided on the circulation passage 65.

Since the liquid discharging apparatus 100C includes the circulation passage 65, it is possible to reuse the liquid LQ having flowed out of the head unit 20C. Therefore, it is possible to avoid wasteful consumption of the liquid LQ, resulting in increased use efficiency of the liquid LQ. An adjuster for adjusting various parameters of the state of the liquid LQ that is to be reused, for example, concentration, viscosity, and/or temperature, may be provided in the liquid reservoir 63 and/or the tank 10. A filter for removing air bubbles or any foreign substance contained in the liquid LQ may be provided on the drain passage 61 and/or the circulation passage 65.

FIG. 7 is a schematic sectional view of the internal structure of the head unit 20C according to the third embodiment. The cross-sectional structure of the head unit 20C taken along a cross-sectional plane passing through the center axis of the nozzle 31, through the flowing-in passage 40, and through the flowing-out passage 70 is schematically illustrated in FIG. 7. Similarly to FIG. 2, an example of a state in which the capacity changing unit 35 has the reference length, the liquid compartment 30 has the reference capacity, and the flowing-in passage 40 has been opened by the flowing-in passage resistance changing unit 50 is illustrated in FIG. 7.

The structure of the head unit 20C according to the third embodiment is substantially the same as that of the head unit 20A according to the first embodiment (FIG. 3), except that the flowing-out passage 70 and a flowing-out passage resistance changing unit 80 are added. The head unit 20C may include two or more nozzles 31 and two or more liquid compartments 30. In the head unit 20C, in the liquid compartment 30, the communication opening 33 that is in communication with the nozzle 31 is located at the side where the flowing-in opening 41 that is in communication with the flowing-in passage 40 is provided with respect to the center-of-displacement portion 37*c*. In addition, within the area located closer to the flowing-in opening 41 than the center-of-displacement portion 37*c* is, the communication opening 33 is located closer to the flowing-in opening 41 than to the center-of-displacement portion 37*c* of the diaphragm 37.

The flowing-out passage 70 is a flow passage formed inside the casing 21 of the head unit 20C and connected to the drain passage 61 (FIG. 6). The flowing-out passage 70 is in communication with the liquid compartment 30 through a flowing-out opening 71, which is open from the liquid compartment 30. The liquid LQ flows out from the liquid compartment 30 through the flowing-out passage 70. In the third embodiment, as viewed in the horizontal direction, the flowing-out passage 70 and the flowing-out opening 71 are provided at the opposite area in the head unit 20C in relation to the area of the flowing-in passage 40 and the flowing-in opening 41; the capacity changing unit 35 and the center-of-displacement portion 37*c* are located therebetween. The flowing-out passage 70 is in communication with the liquid compartment 30 from above, and the flowing-out opening 71 is formed in the ceiling surface 34 of the liquid compartment 30 and is open in the direction of gravity.

In the liquid discharging apparatus 100C, the liquid LQ that was not discharged exits from the head unit 20C through the flowing-out passage 70. This makes it possible to produce a flow of the liquid LQ from the flowing-in passage 40 toward the flowing-out passage 70 in the liquid compartment 30. Such a flow suppresses the deterioration of the liquid LQ caused by the stagnation of the liquid LQ inside the head unit 20C, for example, settlement of sediment components contained in the liquid LQ inside the head unit 20C, a change in liquid concentration due to vaporization, and so forth. This reduces the risk of occurrence of poor discharging, caused by such deterioration of the liquid LQ in the liquid compartment 30, of a liquid droplet DR from the nozzle 31. Moreover, in the liquid discharging apparatus 100C, it is possible to cause air bubbles produced as a result of entry of external air into the liquid compartment 30 to flow out through the flowing-out passage 70 together with the liquid LQ. This reduces the risk of occurrence of poor discharging, caused by the presence of air bubbles inside the liquid compartment 30, of a liquid droplet DR from the nozzle 31.

The flowing-out passage resistance changing unit 80 is provided on the flowing-out passage 70. Under the control of the control unit 25 (FIG. 6), the flowing-out passage resistance changing unit 80 changes the flow resistance of the flowing-out passage 70 by changing the capacity of the flowing-out passage 70, thereby controlling the flow of the liquid LQ between the liquid compartment 30 and the flowing-out passage 70. The flowing-out passage resistance changing unit 80 includes a driver portion 81 and a valve member 82. The driver portion 81 and the valve member 82 of the flowing-out passage resistance changing unit 80 has the same structure as that of the driver portion 51 and the valve member 52 of the flowing-in passage resistance changing unit 50. The driver portion 81 of the flowing-out passage resistance changing unit 80 is housed in a third drive chamber 83.

The third drive chamber 83 is a room formed inside the casing 21 of the head unit 20C. The third drive chamber 83 is located over the flowing-out passage 70. The third drive chamber 83 is located over the liquid compartment 30, and, as viewed in the horizontal direction, is provided at the opposite area in relation to the area of the second drive chamber 53 for the flowing-in passage resistance changing unit 50; the first drive chamber 36 for the capacity changing unit 35 is located therebetween. The flowing-out passage 70 and the third drive chamber 83 are spatially connected to each other via a through hole 84 going straight therebetween. The valve member 82 is provided in the through hole 84 in such a way that its head end portion 86 is exposed into the flowing-out passage 70. Similarly to the through hole 54 for the flowing-in passage resistance changing unit 50, a sealing member (not illustrated) is provided inside the through hole 84. It can be construed that, of the valve member 82, the surface of the portion located inside the flowing-out passage 70 constitutes a part of an inner wall surface of the flowing-out passage 70.

In the flowing-out passage resistance changing unit 80, the driver portion 81 is connected to the tail end portion 87 of the valve member 82, and the driver portion 81 is configured to expand and contract in the vertical direction, thereby causing the valve member 82 to move up and down like a piston. An example of a state of contraction of the driver portion 81, with the length of protrusion of the valve member 82 into the flowing-out passage 70 minimized, is illustrated in FIG. 7. The valve member 82 moves down to increase the length of its protrusion into the flowing-out passage 70 when the driver portion 81 expands from this state. Therefore, the capacity of the flowing-out passage 70 decreases correspondingly, and the flow resistance of the flowing-out passage 70 increases correspondingly. Since the flowing-out passage resistance changing unit 80 operates as described above, the capacity of the flowing-out passage 70 decreases due to the expansion of the driver portion 81, resulting in an increase in the flow resistance of the flowing-out passage 70. Conversely, the capacity of the flowing-out passage 70 increases when the driver portion 81 contracts, resulting in a decrease in the flow resistance of the flowing-out passage 70.

In the third embodiment, the flowing-out passage 70 has a valve seat portion 73, which is similar to the valve seat portion 43 of the flowing-in passage 40. The valve seat portion 73 is provided at a position where it faces the head end portion 86 of the valve member 82 of the flowing-out passage resistance changing unit 80. In the third embodiment, the flowing-out opening 71 is provided under the valve seat portion 73. When the length of protrusion of the valve member 82 into the flowing-out passage 70 is maximized, the head end portion 86 of the valve member 82 comes into contact with the inner wall surface of the valve seat portion 73 to close the flowing-out passage 70. As described above, in the third embodiment, the flowing-out passage resistance changing unit 80 is configured to close the flowing-out passage 70 by moving the valve member 82 in the direction of increasing the flow resistance of the flowing-out passage 70. The flowing-out passage resistance changing unit 80 is configured to open the flowing-out passage 70 by moving the valve member 82 in the direction of decreasing the flow resistance of the flowing-out passage 70.

Figure 8:
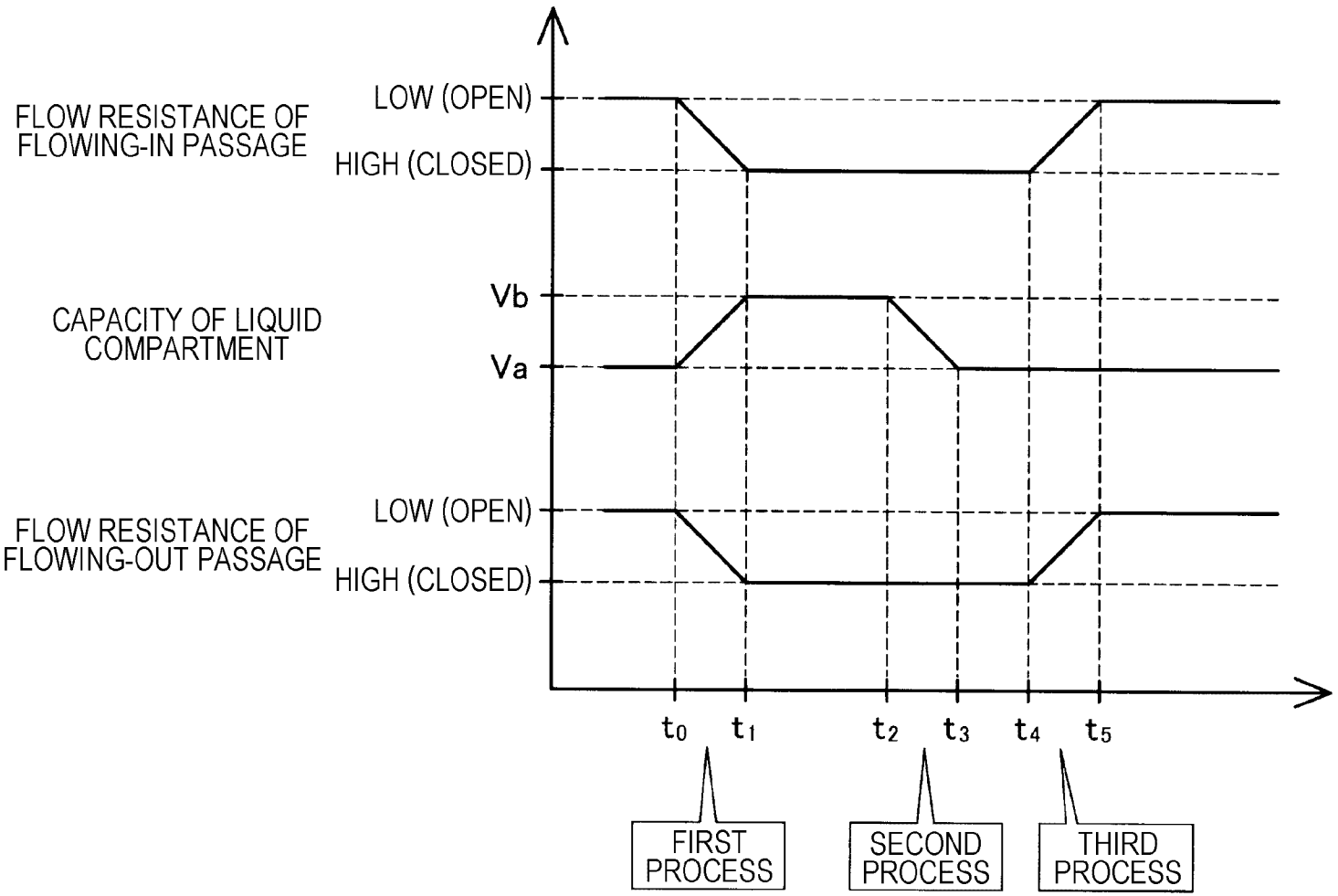
FIG. 8 is a timing chart of discharge processing according to the third embodiment.

With reference to FIG. 8, a preferred example of discharge processing, suitable for the liquid discharging apparatus 100C for ejecting a liquid droplet DR, will now be explained. FIG. 8, which is a timing chart for explaining discharge processing, is substantially the same as FIG. 3, except that the timing of changing the flow resistance of the flowing-out passage 70 by the flowing-out passage resistance changing unit 80 is added. In discharge processing according to the third embodiment, unless otherwise described below, the control unit 25 performs substantially the same processing as the processing described in the first embodiment.

The control unit 25 puts the head unit 20C into an initial state illustrated in FIG. 7 before starting the execution of discharge processing. In the initial state, the capacity of the liquid compartment 30 is the reference capacity Va, and the flowing-in passage 40 and the flowing-out passage 70 are open with low flow resistance.

In the first process of discharge processing (from a point in time $t_0$ to a point in time $t_1$ in FIG. 8), the control unit 25 causes the flowing-in passage resistance changing unit 50 to close the flowing-in passage 40 and increase the flow resistance of the flowing-in passage 40, and, in addition, causes the flowing-out passage resistance changing unit 80 to close the flowing-out passage 70 and increase the flow resistance of the flowing-out passage 70. In addition to causing the flowing-in passage resistance changing unit 50 to decrease the capacity of the flowing-in passage 40 and causing the flowing-out passage resistance changing unit 80 to decrease the capacity of the flowing-out passage 70, the control unit 25 causes the capacity changing unit 35 to increase the capacity of the liquid compartment 30 from the reference capacity Va to the before-discharge capacity Vb. Accordingly, a buffer space for accommodation of the liquid LQ forced out of the flowing-in passage 40 and the flowing-out passage 70 due to the decrease in the capacity of the flowing-in passage 40 and the flowing-out passage 70 is produced in the liquid compartment 30. Therefore, it is possible to avoid the meniscus of the nozzle 31 from being destroyed as a result of the operation performed by the flowing-in passage resistance changing unit 50 and the flowing-out passage resistance changing unit 80, thereby avoiding the liquid LQ from flowing out from the nozzle 31.

Preferably, the increase from the reference capacity Va to the before-discharge capacity Vb should be not less than the volume of the liquid LQ that would flow out through the communication opening 33 if the open flowing-in passage 40 and the open flowing-out passage 70 were closed without driving the capacity changing unit 35 at all in a state in which the liquid compartment 30 is filled with the liquid LQ. In the first process, the timing and/or speed of increasing the capacity of the liquid compartment 30 by the capacity changing unit 35, the timing and/or speed of decreasing the capacity of the flowing-out passage 70 by the flowing-out passage resistance changing unit 80, and the timing and/or speed of decreasing the capacity of the flowing-in passage 40 by the flowing-in passage resistance changing unit 50 may be different from one another. The timing and/or speed thereof may have been determined in advance on the basis of the type of the liquid LQ, the shape of the flow passage inside the head unit 20C for the liquid LQ, and/or the like.

After the first process, in the second process (from a point in time $t_2$ to a point in time $t_3$ in FIG. 8), the control unit 25 causes the capacity changing unit 35 to decrease the capacity of the liquid compartment 30, thereby causing the liquid LQ to start going out from the nozzle 31, as done in the first embodiment described earlier. As described above, in preparation for starting the outputting of the liquid LQ from the nozzle 31, the control unit 25 caused the flowing-in passage resistance changing unit 50 to decrease the capacity of the flowing-in passage 40 and caused the flowing-out passage resistance changing unit 80 to decrease the capacity of the flowing-out passage 70 before causing the capacity changing unit 35 to decrease the capacity of the liquid compartment 30. Since the flowing-in passage 40 and the flowing-out passage 70 have been put into a state of high flow resistance in advance, the pressure increased by the capacity changing unit 35 in the second process does not escape into the flowing-in passage 40 and the flowing-out passage 70. Therefore, it is possible to efficiently transmit, to the nozzle 31, the pressure for causing the liquid LQ to go out from the nozzle 31.

In the third process (from a point in time $t_4$ to a point in time $t_5$ in FIG. 8), the control unit 25 causes the flowing-in passage resistance changing unit 50 to increase the capacity of the flowing-in passage 40 and causes the flowing-out passage resistance changing unit 80 to increase the capacity of the flowing-out passage 70 during the going out of the liquid LQ from the nozzle 31. Due to the increase in the capacity of the flowing-in passage 40 and the flowing-out passage 70, temporarily, pressure that acts in a direction of sucking the liquid LQ toward the flowing-in passage 40 and the flowing-out passage 70 is produced inside the liquid compartment 30. This pressure acts in a direction of separating, from the liquid LQ retained at the nozzle 31, the liquid LQ going out from the nozzle 31. Consequently, a liquid droplet DR separated from the liquid LQ of the nozzle 31 is released into the air. In the third process, the operation of increasing the capacity of the flowing-out passage 70 by the flowing-out passage resistance changing unit 80 may be omitted.

In the head unit 20C, similarly to the head unit 20A according to the first embodiment, the nozzle 31 is provided relatively near the flowing-in opening 41 of the flowing-in passage 40. This structure makes it easier for the above-mentioned pressure, which is produced by increasing the capacity of the flowing-in passage 40 in the third process and acts in the direction of sucking the liquid LQ contained in the liquid compartment 30 toward the flowing-in passage 40, to reach the liquid LQ of the nozzle 31. Moreover, in the head unit 20C, similarly to the head unit 20A according to the first embodiment, the communication opening 33 is located closer to the flowing-in opening 41 than to the center-of-displacement portion 37*c* of the diaphragm 37. This structure further makes it easier for a pressure change caused by the operation performed by the flowing-in passage resistance changing unit 50 to reach and act on the nozzle 31.

As explained above, since the nozzle 31 is provided relatively near the flowing-in opening 41, the liquid discharging apparatus 100C according to the third embodiment offers enhanced controllability and enhanced reliability in discharging a liquid droplet DR by the head unit 20C. Moreover, since the flowing-out passage 70 is provided in the head unit 20C, it is possible to cause air bubbles to flow out and prevent the liquid LQ from stagnating inside the liquid compartment 30. Furthermore, the use efficiency of the liquid LQ increases because it is possible to return, to the head unit 20C through the circulation passage 65, the liquid LQ having flowed out through the flowing-out passage 70. In addition to the above effects, the liquid discharging apparatus 100C according to the third embodiment produces various operational effects that are similar to those described in the first embodiment.

D. Fourth Embodiment

Figure 9:
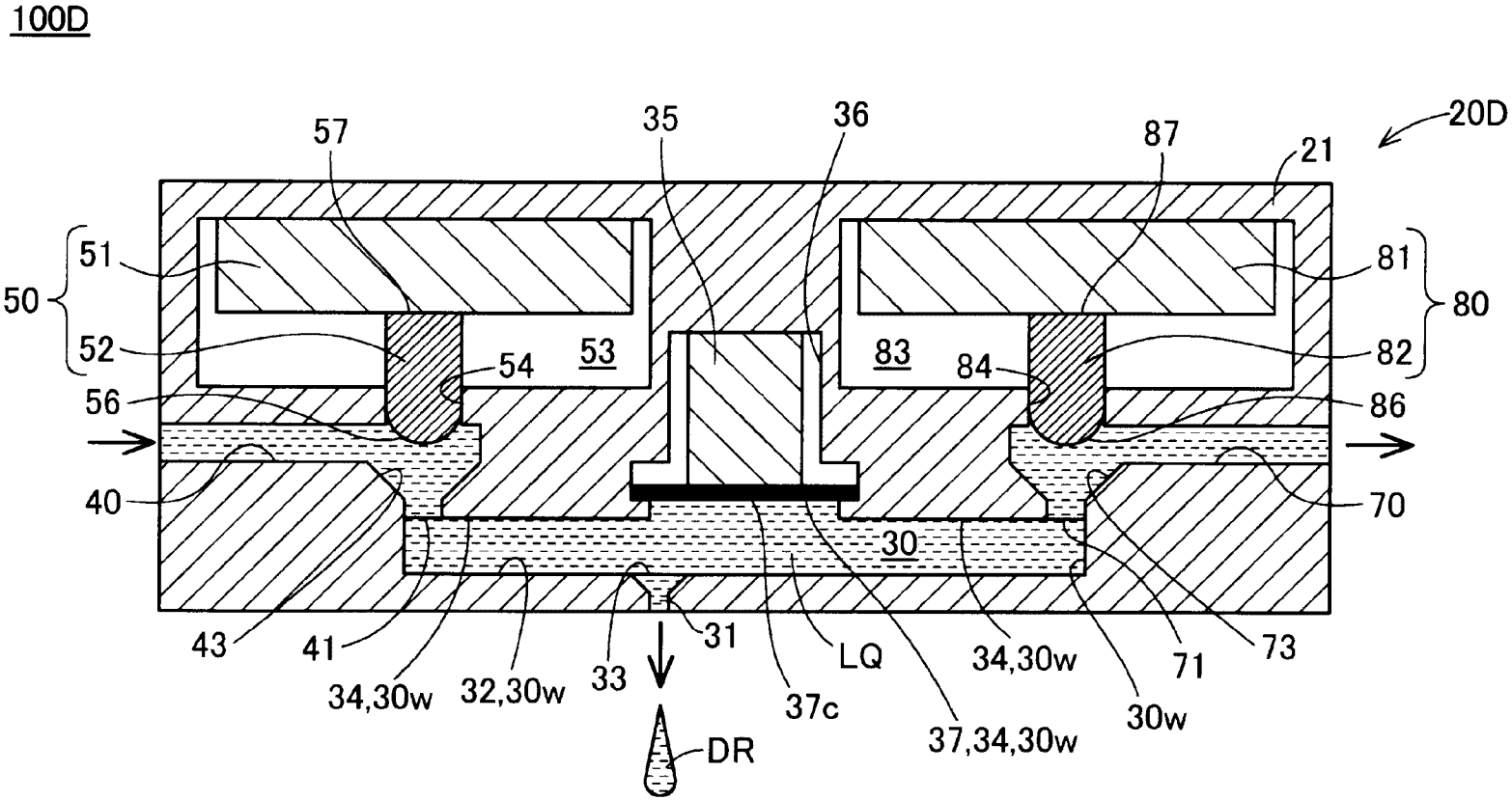
FIG. 9 is a schematic sectional view of the internal structure of a head unit according to a fourth embodiment.

FIG. 9 is a schematic sectional view of the internal structure of a head unit 20D of a liquid discharging apparatus 100D according to a fourth embodiment. The structure of the liquid discharging apparatus 100D according to the fourth embodiment is substantially the same as that of the liquid discharging apparatus 100C according to the third embodiment (FIG. 6), except that the head unit 20C according to the third embodiment is replaced with the head unit 20D according to the fourth embodiment. The structure of the head unit 20D according to the fourth embodiment is substantially the same as that of the head unit 20C according to the third embodiment (FIG. 7), except that, in the liquid compartment 30, the position where the nozzle 31 is formed and where its communication opening 33 is formed is different from the position in the third embodiment. In the liquid discharging apparatus 100D according to the fourth embodiment, the control unit 25 performs discharge processing similar to the discharge processing described in the third embodiment (FIG. 8).

In the head unit 20D according to the fourth embodiment, similarly to the head unit 20B according to the second embodiment, in the liquid compartment 30, within the area located closer to the flowing-in opening 41 than the center-of-displacement portion 37*c* is, the communication opening 33 is located closer to the center-of-displacement portion 37*c* of the diaphragm 37 than to the flowing-in opening 41. Because of this structure, in the head unit 20D according to the fourth embodiment, it is easier for a pressure change caused by the capacity changing unit 35 to reach the nozzle 31 as compared with the head unit 20C according to the third embodiment. Therefore, it is possible to efficiently transmit, to the nozzle 31, the pressure generated by the capacity changing unit 35 for causing the liquid LQ to go out from the nozzle 31. In addition to the above effect, the liquid discharging apparatus 100D according to the fourth embodiment produces various operational effects that are similar to those described in the foregoing embodiments.

E. Other Embodiments

Various examples of structure described in the foregoing embodiments may be, for example, modified as described below. Each of other embodiments described below shall be understood as an example for carrying out an aspect of the invention, similarly to the foregoing embodiments.

E1. Other Embodiment 1

In the foregoing embodiments, each of the capacity changing unit 35, the driver portion 51 of the flowing-in passage resistance changing unit 50, and the driver portion 81 of the flowing-out passage resistance changing unit 80 is made of a piezoelectric element. However, the capacity changing unit 35, the driver portion 51, 81 may be made of an actuator other than a piezoelectric element. The capacity changing unit 35, the driver portion 51, 81 may be, for example, made of other kind of actuator such as an air cylinder, a solenoid, or a magnetostrictor, etc.

E2. Other Embodiment 2

In the foregoing embodiments, the capacity changing unit 35 changes the capacity of the liquid compartment 30 by deforming the diaphragm 37, which constitutes a part of an inner wall surface 30*w* of the liquid compartment 30. However, other structure may be adopted for changing the capacity of the liquid compartment 30 by the capacity changing unit 35. For example, the capacity changing unit 35 may change the capacity of the liquid compartment 30 by causing a valve member constituting a part of a wall portion of the liquid compartment 30 to move like a piston.

E3. Other Embodiment 3

In the foregoing embodiments, the flowing-in passage resistance changing unit 50 operates to open/close the flowing-in passage 40. However, the flowing-in passage resistance changing unit 50 does not have to put the flowing-in passage 40 into a perfectly open/closed state. It suffices that the flowing-in passage resistance changing unit 50 changes the flow resistance of the flowing-in passage 40 by performing the operation of changing the capacity of the flowing-in passage 40. In this case, the valve seat portion 43 of the flowing-in passage 40 may be omitted. The same holds true for the valve seat portion 73 of the flowing-out passage 70 for the flowing-out passage resistance changing unit 80. In the foregoing embodiments, the operation of changing the capacity of the flowing-in passage 40 by the flowing-in passage resistance changing unit 50 may be construed as the operation of changing the cross-sectional flow area of the flowing-in passage 40. The same holds true for the operation of changing the capacity of the flowing-out passage 70 by the flowing-out passage resistance changing unit 80.

E4. Other Embodiment 4

In the foregoing embodiments, the flowing-in passage resistance changing unit 50 changes the capacity of the flowing-in passage 40 to change the flow resistance of the flowing-in passage 40 by movement of the valve member 52 driven by the driver portion 51. However, a modified structure different from that of the foregoing embodiments may be adopted for changing the capacity of the flowing-in passage 40 to change the flow resistance of the flowing-in passage 40 by the flowing-in passage resistance changing unit 50. For example, similarly to the capacity changing unit 35, the flowing-in passage resistance changing unit 50 may change the capacity of the flowing-in passage 40 by deforming a diaphragm that constitutes a part of an inner wall surface of the flowing-in passage 40. Alternatively, the flowing-in passage resistance changing unit 50 may change the capacity of the flowing-in passage 40 to change the flow resistance of the flowing-in passage 40 by means of a shutter wall portion configured to move across the flowing-in passage 40. The same modification in structure may be applied to the flowing-out passage resistance changing unit 80.

E5. Other Embodiment 5

In the foregoing embodiments, the communication opening 33 of the nozzle 31 is located away from the area under the diaphragm 37. However, the communication opening 33 of the nozzle 31 may be located within the area under the diaphragm 37. In this case, it suffices that, within the area under the diaphragm 37, the communication opening 33 of the nozzle 31 is located at the side where the flowing-in opening 41 is provided with respect to the center-of-displacement portion 37*c*.

E6. Other Embodiment 6

In the foregoing embodiments, the flowing-in passage 40 is formed above the liquid compartment 30, and the flowing-in opening 41 is formed as an opening in the ceiling surface 34 of the liquid compartment 30. However, the flowing-in passage 40 does not have to be formed above the liquid compartment 30, and the flowing-in opening 41 may be formed as an opening in other surface, instead of the ceiling surface 34, of the liquid compartment 30. For example, the flowing-in passage 40 may be formed below the liquid compartment 30 or laterally adjacent to the liquid compartment 30. The flowing-in opening 41 may be formed as an opening in the floor surface 32 of the liquid compartment 30 or an opening in a sidewall surface of the liquid compartment 30.

E7. Other Embodiment 7

In the third and fourth embodiments, the flowing-out passage resistance changing unit 80 may be omitted. A structure of not circulating the liquid LQ, with the omission of the circulation passage 65, may be applied to the liquid discharging apparatus 100C, 100D according to the third, fourth embodiment. For example, the liquid LQ having flowed out into the drain passage 61 may be drained to the outside, without circulation.

E8. Other Embodiment 8

In the foregoing embodiments, discharge processing executed by the liquid discharging apparatus 100A-100D merely shows preferred examples. The liquid discharging apparatus 100A-100D according to the foregoing embodiments may execute various modified discharge processing. For example, in discharge processing according to the foregoing embodiments, the first process, in which the capacity of the flowing-in passage 40 is decreased by the flowing-in passage resistance changing unit 50 and in which the capacity of the liquid compartment 30 is increased by the capacity changing unit 35, may be omitted. In the liquid discharging apparatus 100A-100D according to the foregoing embodiments, the pressure of the liquid compartment 30 may be increased by decreasing the capacity of the flowing-in passage 40 by the flowing-in passage resistance changing unit 50 concurrently with decreasing the capacity of the liquid compartment 30 by the capacity changing unit 35, thereby causing the liquid LQ to start going out from the nozzle 31. In discharge processing according to the third and fourth embodiments, the flowing-out passage 70 may be kept open without driving the flowing-out passage resistance changing unit 80 when the flowing-in passage 40 is put into a closed state by the flowing-in passage resistance changing unit 50.

E9. Other Embodiment 9

The scope of application of the invention is not limited to a liquid discharging apparatus that discharges ink. The invention may be applied to any other liquid discharging apparatus that discharges, instead of ink, other kind of liquid. For example, the invention may be applied to the following various kinds of liquid discharging apparatus:

(1) An image recording apparatus such as a facsimile apparatus, etc.

(2) A color material discharging apparatus used in color filter production for an image display device such as a liquid crystal display, etc.

(3) An electrode material discharging apparatus used in electrode forming of an organic EL (Electro Luminescence) display, a surface-emitting display (Field Emission Display, FED), etc.

(4) A liquid discharging apparatus for discharging a liquid containing a living organic material used in biochip fabrication (5) A sample discharging apparatus as a high precision pipette (6) A lubricating oil discharging apparatus (7) A liquid resin discharging apparatus (8) A liquid discharging apparatus for discharging, with pinpoint accuracy, lubricating oil onto a precision device such as a watch, a camera, etc.

(9) A liquid discharging apparatus for discharging transparent liquid resin such as ultraviolet ray curing resin onto a substrate so as to form a micro hemispherical lens (optical lens) used in an optical communication element, etc.

(10) A liquid discharging apparatus for discharging an acid etchant or an alkaline etchant for etching a substrate, etc.

(11) A liquid discharging apparatus equipped with a liquid discharging head for discharging any other micro droplets In this specification, any material that can be consumed by a liquid discharging apparatus suffices as "liquid". For example, "liquid" may be any substance that is in the liquid phase, including but not limited to: a material that is in a state of liquid having high viscosity or low viscosity, sol or gel water, or other material that is in a state of liquid such as inorganic solvent, organic solvent, solution, liquid resin, or liquid metal (metal melt). The term "liquid" encompasses not only liquid as a state of substance but also liquid made as a result of dissolution, dispersion, or mixture of particles of a functional material made of a solid such as pigment or metal particles, etc. into/with a solvent. Typical examples of "liquid" are ink and liquid crystal. The term "ink" encompasses various kinds of liquid composition such as popular water-based ink, oil-based ink, gel ink, hot melt ink, etc. The term "liquid droplet" refers to a state of liquid discharged from a liquid discharging apparatus and encompasses a particulate droplet, a tear-shaped droplet, and a droplet that forms a thread tail.

E10. Other Embodiment 10

In the foregoing embodiments, a part or a whole of functions and processing implemented by software may be implemented by hardware. A part or a whole of functions and processing implemented by hardware may be implemented by software. Various kinds of circuit can be used as hardware, for example, an integrated circuit, a discrete circuit, or a circuit module that is a combination of these circuits.

The scope of the invention is not limited to the foregoing embodiments, examples, and variations/modifications. The invention may be embodied in various ways within a range of not departing from its spirit. For example, technical features in embodiments, examples, and variations/modifications corresponding to those described in "Summary" may be replaced or combined in order to solve a part of a whole of the aforementioned problems or produce a part of a whole of the aforementioned effects. Some technical features may be removed unless they are explained as indispensable in this specification; this is not limited to a case where technical features are explicitly described as non-essential in this specification.

The entire disclosure of Japanese Patent Application No.: 2017-107669, filed May 31, 2017 is expressly incorporated by reference herein.

What is claimed is:

1. A liquid discharging apparatus, comprising:

a liquid compartment that contains a liquid;

a flowing-in passage that is in communication with the liquid compartment through a flowing-in opening for the liquid compartment, the liquid flowing through the flowing-in passage into the liquid compartment;

a nozzle that is in communication with the liquid compartment through a communication opening for the liquid compartment, the liquid contained in the liquid compartment being discharged from the nozzle;

a capacity changer that causes the liquid to be discharged from the nozzle by causing a displacement of an inner wall surface of the liquid compartment and changing capacity of the liquid compartment; and a flowing-in passage resistance changer that changes capacity of the flowing-in passage to change flow resistance of the flowing-in passage, wherein, in the liquid compartment, the communication opening is located at a same side where the flowing-in opening is provided with respect to a location where a center-of-displacement portion is provided so that the communication opening is between the flowing-in opening and the center-of-displacement, wherein the center-of-displacement portion is a portion where an amount of the displacement of the inner wall surface that is displaced by the capacity changer is largest.

2. The liquid discharging apparatus according to claim 1, wherein, in the liquid compartment, within an area located closer to the flowing-in opening than the center-of-displacement portion is, the communication opening is located closer to the flowing-in opening than to the center-of-displacement portion.

3. The liquid discharging apparatus according to claim 1, wherein, in the liquid compartment, within an area located closer to the flowing-in opening than the center-of-displacement portion is, the communication opening is located closer to the center-of-displacement portion than to the flowing-in opening.

4. The liquid discharging apparatus according to claim 1, further comprising:

a flowing-out passage through which the liquid flows out from the liquid compartment.

5. The liquid discharging apparatus according to claim 4, further comprising:

a circulation passage for circulation, to the liquid compartment, of the liquid flowing out through the flowing-out passage.

6. The liquid discharging apparatus according to claim 4, further comprising:

a flowing-out passage resistance changer that changes capacity of the flowing-out passage to change flow resistance of the flowing-in passage; and a controller that controls the capacity changer, the flowing-in passage resistance changer, and the flowing-out passage resistance changer, and executes discharge processing for discharging the liquid in a form of a droplet from the nozzle, wherein, in the discharge processing, the controller causes the liquid to start going out from the nozzle by causing the capacity changer to decrease the capacity of the liquid compartment, and causes the flowing-in passage resistance changer to increase the capacity of the flowing-in passage during the going out of the liquid from the nozzle so as to separate the droplet from the liquid of the nozzle and release the droplet into air; and wherein, in the discharge processing, before causing the capacity changer to decrease the capacity of the liquid compartment so as to cause the liquid to start going out from the nozzle, the controller causes the flowing-in passage resistance changer to increase the flow resistance of the flowing-in passage and causes the flowing-out passage resistance changer to increase the flow resistance of the flowing-out passage.

7. The liquid discharging apparatus according to claim 1, further comprising:

a controller that controls the capacity changer and the flowing-in passage resistance changer, and executes discharge processing for discharging the liquid in a form of a droplet from the nozzle, wherein, in the discharge processing, the controller causes the liquid to start going out from the nozzle by causing the capacity changer to decrease the capacity of the liquid compartment, and causes the flowing-in passage resistance changer to increase the capacity of the flowing-in passage during the going out of the liquid from the nozzle so as to separate the droplet from the liquid of the nozzle and release the droplet into air.

8. The liquid discharging apparatus according to claim 7, wherein, in the discharge processing, before causing the capacity changer to decrease the capacity of the liquid compartment so as to cause the liquid to start going out from the nozzle, the controller causes the flowing-in passage resistance changer to increase the flow resistance of the flowing-in passage.

9. The liquid discharging apparatus according to claim 7, wherein the controller causes the capacity changer to increase the capacity of the liquid compartment in a process of causing the flowing-in passage resistance changer to decrease the capacity of the flowing-in passage.

* * * * *